US011024242B1

(12) United States Patent
Lin et al.

(10) Patent No.: US 11,024,242 B1
(45) Date of Patent: Jun. 1, 2021

(54) TIMING CONTROLLER AND OPERATION METHOD THEREOF

(71) Applicant: Novatek Microelectronics Corp., Hsinchu (TW)

(72) Inventors: Hui-Feng Lin, Taichung (TW); Yen-Tao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/816,238

(22) Filed: Mar. 11, 2020

(51) Int. Cl.
*G09G 3/32* (2016.01)
*G09G 3/36* (2006.01)

(52) U.S. Cl.
CPC ..... *G09G 3/3611* (2013.01); *G09G 2310/08* (2013.01); *G09G 2320/029* (2013.01); *G09G 2320/0247* (2013.01)

(58) Field of Classification Search
CPC ..... G09G 3/32; G09G 2300/0426; G09G 2320/0233; G09G 3/2003; G09G 2320/064; G09G 3/3233; G09G 2310/08; G09G 2300/026
See application file for complete search history.

(56) References Cited

U.S. PATENT DOCUMENTS 10,629,114 B2 * 4/2020 Lin ..... G09G 3/3233
2008/0001974 A1 * 1/2008 Kim ..... G09G 3/3233 345/690
2008/0024398 A1 * 1/2008 Hwang ..... G09G 3/20 345/60
2009/0109147 A1 * 4/2009 Park ..... G09G 3/3233 345/76
2009/0160880 A1 * 6/2009 Park ..... G09G 3/3233 345/690
2009/0289961 A1 * 11/2009 Kim ..... G09G 3/3406 345/690
2014/0160178 A1 * 6/2014 Hong ..... G09G 3/2007 345/690
2016/0351138 A1 * 12/2016 Wang ..... G09G 3/3614
2017/0232883 A1 * 8/2017 Dzyubyk ..... B60Q 1/1423 315/82
2018/0240399 A1 * 8/2018 Lin ..... G09G 3/32

* cited by examiner

*Primary Examiner* — Olga V Merkoulova
(74) *Attorney, Agent, or Firm* — JCIPRNET

(57) ABSTRACT

A timing controller and an operation method thereof are provided. The timing controller is used to control a signal timing of a display panel. The timing controller includes an analysis circuit and a decision circuit. The analysis circuit analyzes the content of an image frame to obtain an analysis result. The decision circuit is coupled to the analysis circuit to receive the analysis result. The decision circuit determines a global gray level according to the analysis result. In a blanking interval in which a plurality of sub-pixel circuits of the display panel are turned off, a data voltage corresponding to the global gray level is applied to at least one data line of the display panel corresponding to the sub-pixel circuits.

25 Claims, 3 Drawing Sheets

TIMING CONTROLLER AND OPERATION METHOD THEREOF

BACKGROUND

Field of the Invention

The invention relates to a display apparatus and more particularly, to a timing controller and an operation method thereof.

Description of Related Art

In an operation process, a refresh rate (or referred to as a frame rate) of a display panel is dynamically changed, which means that a length of a vertical blanking interval is dynamically changed. Generally, as the refresh rate (or the frame rate) is reduced, the length of the vertical blanking interval is increased. When the length of the vertical blanking interval is changed, gray level voltages stored in a plurality of pixel circuits of the display panel are changed due to the occurrence of a leakage current of thin film transistors (TFTs). Thus, when the refresh rate (or the frame rate) is dynamically changed, a conventional liquid crystal display (LCD) noticeably flickers.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY

The invention provides a timing controller and an operation method thereof for preventing a screen from flickering as much as possible during a process in which a refresh rate (or a frame rate) is changed.

A timing controller of the invention is configured to control a signal timing of a display panel. The timing controller includes an analysis circuit and a decision circuit. The analysis circuit is configured to analyze a content of an image frame to obtain an analysis result. The decision circuit is coupled to the analysis circuit to receive the analysis result. The decision circuit is configured to determine a global gray level according to the analysis result. In a blanking interval in which a plurality of sub-pixel circuits of the display panel are turned off, a data voltage corresponding to the global gray level is applied to at least one data line of the display panel corresponding to the sub-pixel circuits.

An operation method of the invention includes: analyzing a content of an image frame by an analysis circuit of the timing controller to obtain an analysis result; determining a global gray level according to the analysis result by a decision circuit of the timing controller; and in a blanking interval in which a plurality of sub-pixel circuits of the display panel are turned off, applying a data voltage corresponding to the global gray level to at least one data line of the display panel corresponding to the sub-pixel circuits.

To sum up, the timing controller and the operation method thereof provided by the embodiments of the invention can analyze the content of the image frame to obtain the analysis result, so as to determine the global gray level according to the analysis result. In the blanking interval (i.e., a period, in which the plurality of sub-pixel circuits of the display panel are turned off, and includes, for example, a vertical blanking interval and (or) a horizontal blanking interval), the data voltage corresponding to the global gray level can be applied to the at least one data line of the display panel corresponding to the sub-pixel circuits, thereby compensating a leakage current situation of thin film transistors (TFTs) of the sub-pixel circuits. Thus, the timing controller can prevent the screen from flickering as much as possible during the process in which the refresh rate (or a frame rate) is changed. In addition, because the data voltage (the global gray level) is applied to the data lines corresponding to the sub-pixel circuits in the period in which the sub-pixel circuits are all turned off, gray level voltages (pixel voltages) stored in the sub-pixel circuits are not changed by the data voltage (the global gray level).

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
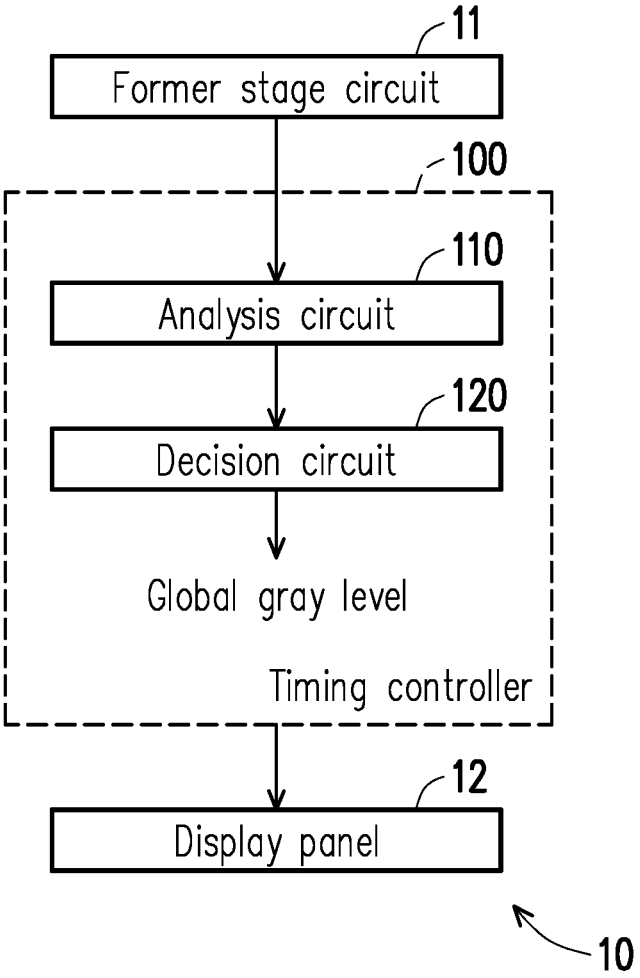
FIG. 1 is a schematic circuit block diagram illustrating a display apparatus according to an embodiment of the invention.

The term "couple (or connect)" throughout the specification (including the claims) of this application are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. In addition, terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

FIG. 1 is a schematic circuit block diagram illustrating a display apparatus 10 according to an embodiment of the invention. The display apparatus 10 illustrated in FIG. 1 includes a former stage device 11, a timing controller 100 and a display panel 12. Based on a design requirement, the former stage circuit 11 may include a scaling circuit, an application process (AP), a microprocessor, a micro processor unit (MPU), a digital signal processor (DSP) and (or) other circuits. Based on a design requirement, the display panel 12 may include a source driver, a gate driver, a gate on array (GOA) circuit and (or) any other driving circuit. Based on a design requirement, the display panel 12 may be any type of display panel, for example, a liquid crystal display (LCD) panel.

The timing controller 100 may control a signal timing of the display panel 12 and provide pixel data of an image frame to the aforementioned driving circuit of the display panel 12. Based on the control of the timing controller 100, the display panel 12 may display the image frame. For example, in an active period, an output circuit (not shown) of the timing controller 100 may output the pixel data of the image frame to the driving circuit of the display panel 12. Based on a design requirement, the output circuit of the timing controller 100 may be a conventional output circuit or other output circuits. The driving circuit of the display panel 12 may convert the pixel data into pixel voltages (gray level voltages). The driving circuit of the display panel 12 may turn on sub-pixel circuits of the display panel 12 in the aforementioned active period and store the pixel voltages (the gray level voltages) corresponding to the image frame in different sub-pixel circuits of the display panel 12. Thus, the display panel 12 may display the image frame. In a blanking interval, the pixel data of the image frame is not output to the driving circuit of the display panel 12, and the driving circuit of the display panel 12 turns off all the sub-pixel circuits of the display panel 12.

In the embodiment illustrated in FIG. 1, the timing controller 100 further includes an analysis circuit 110 and a decision circuit 120. The analysis circuit 110 may receive the image frame, external information and (or) other information from the front stage circuit 11.

Figure 2:
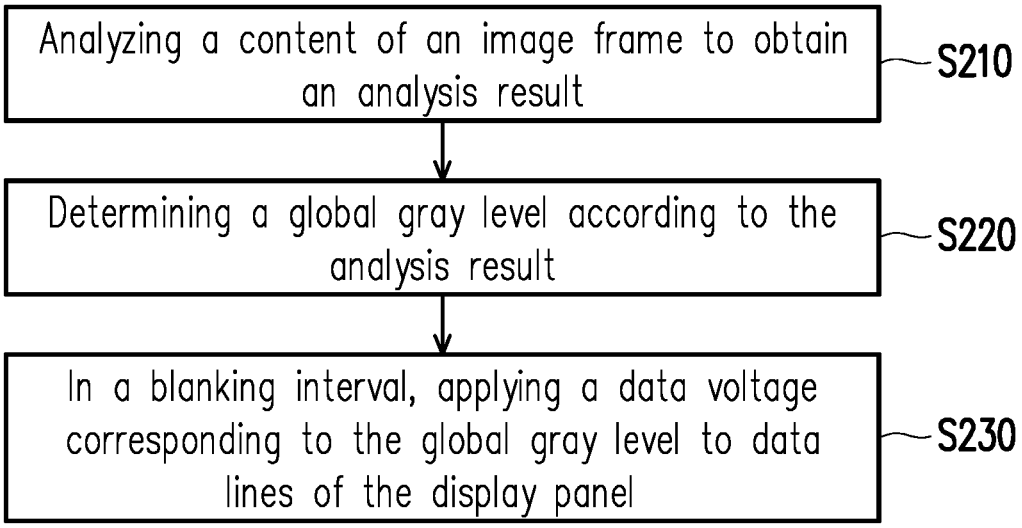
FIG. 2 is a flowchart illustrating an operation method of a display apparatus according to an embodiment of the invention.

FIG. 2 is a flowchart illustrating an operation method of a display apparatus according to an embodiment of the invention. Referring to FIG. 1 and FIG. 2, in step S210, the analysis circuit 110 may analyze a content of the image frame to obtain an analysis result. In some embodiments (but not limited thereto), the analysis circuit 110 may analyze a gray level distribution of the image frame to obtain the analysis result. For example, the image frame includes a plurality of pixels, each of the pixels includes a plurality of sub-pixels (e.g., red, green and a blue sub-pixels), and the analysis circuit 110 may select a gray level value from gray level values of the sub-pixels of a current pixel among the pixels as a representative gray level value of the current pixel. Based on a design requirement, the representative gray level value of the current pixel is a maximum gray level value, a median gray level value, a minimum gray level value or an average gray level value among the gray level values of the sub-pixels of the current pixel. The analysis circuit 110 may analyze a gray level distribution of the representative gray level values of these pixels to obtain the analysis result.

Specific contents related to the analysis result may be schemed based on a design requirement. For example, in some embodiments, the analysis result includes a "primary gray level value $GL_{max}$". In the present embodiment, the primary gray level value $GL_{max}$ may refer to a gray level value with a most screen ratio of an image frame, wherein the "screen ratio" may refer to a ratio of the number of pixels having the same gray level value to a total number of the pixels of a screen (the image frame). For example, it is assumed that an image frame has 10 pixels, and gray level values of the 10 pixels are 23, 75, 75, 125, 188, 75, 125, 23, 23 and 75, respectively. A screen ratio corresponding to the "gray level value of 23" is 3/10, a screen ratio corresponding to the "gray level value of 75" is 4/10, a screen ratio corresponding to the "gray level value of 125" is 2/10, and a screen ratio corresponding to the "gray level value of 188" is 1/10. Accordingly, the primary gray level value $GL_{max}$ is "75".

In some other embodiments, the analysis result includes the "primary gray level value $GL_{max}$", and the analysis circuit 110 may quantize a plurality of gray level values of a plurality of pixels of an image frame to obtain a plurality of quantized values of the pixels. In the present embodiment, the primary gray level value $GL_{max}$ is a quantized value with a most screen ratio among the quantized values, wherein the "screen ratio" may refer to a ratio of the number of pixels having the same quantized value to a total number of the pixels of a screen (the image frame). Specific operations of the quantization may be schemed based on a design requirement. For example, the analysis circuit 110 may quantize a plurality of gray level values of a plurality of pixels of an image frame by using Table 1. A range assumed in the example shown in Table 1 is from 0 to 255, however, ranges of gray level values in other embodiments are not limited thereto.

TABLE 1

An example of quantization table

| Quantized value | Gray level value |
|---|---|
| 0 | 0 to 31 |
| 32 | 32 to 63 |
| 64 | 64 to 95 |
| 96 | 96 to 127 |
| 128 | 128 to 159 |
| 160 | 160 to 191 |
| 192 | 192 to 223 |
| 224 | 224 |
| 225 | 225 |

For example, it is assumed that an image frame has 10 pixels, and gray level values of the 10 pixels are 23, 75, 75, 125, 188, 75, 125, 23, 23 and 75, respectively. According to the example shown in Table 1, the gray level values of the 10 pixels are quantized as quantized values of 0, 64, 64, 96, 160, 64, 96, 0, 0 and 64. A screen ratio corresponding to the "quantized value of 0" is 3/10, a screen ratio corresponding to the "quantized value of 64" is 4/10, a screen ratio corresponding to the "quantized value of 96" is 2/10, and a screen ratio corresponding to the "quantized value of 160" is 1/10. Thus, the primary gray level value $GL_{max}$ is "64".

In some other embodiments, the analysis result includes an "average gray level value $GL_{avg}$". The average gray level value $GL_{avg}$ is an average value of a plurality of gray level values of a plurality of pixels of an image frame. For example, it is assumed that an image frame has 10 pixels, and gray level values of the 10 pixels are 23, 75, 75, 125, 188, 75, 125, 23, 23 and 75, respectively. Thus, the aforementioned average gray level value $GL_{avg}$ is calculated by (23+75+75+125+188+75+125+23+23+75)/10, which is 80.7.

In some other embodiments, the analysis result includes the "average gray level value $GL_{avg}$", and the analysis circuit 110 may quantize a plurality of gray level values of a plurality of pixels of an image frame to obtain a plurality of quantized values of the pixels. The average gray level value may be an average value of these quantized values.

Specific operations of the quantization may be schemed based on a design requirement. For example, the analysis circuit 110 may quantize a plurality of gray level values of a plurality of pixels of an image frame by using Table 1 described above. For example, it is assumed that an image frame has 10 pixels, and gray level values of the 10 pixels are 23, 75, 75, 125, 188, 75, 125, 23, 23 and 75, respectively. According to the example shown in Table 1, the gray level values of the 10 pixels are quantized as quantized values of 0, 64, 64, 96, 160, 64, 96, 0, 0 and 64. Thus, the aforementioned average gray level value $GL_{avg}$ is calculated by (0+64+64+96+160+64+96+0+0+64)/10, which is 60.8.

The decision circuit 120 is coupled to the analysis circuit 110 to receive the recognition result. In step S220, the decision circuit 120 may determine a global gray level according to the analysis result. For example, in some embodiments, the decision circuit 120 may calculate the global gray level by using at least one weight and the analysis result. In some embodiments, the weight may be a static value (or a fixed value) set based on a design requirement. In some other embodiments, the decision circuit 120 may dynamically determine the weight according to the analysis result. A relation between the analysis result and the weight may be schemed based on a design requirement.

In some embodiments, the analysis result includes the primary gray level value $GL_{max}$, and the weight includes a weight α. In some embodiments, the weight α may be a static value (or a fixed value) set based on a design requirement. In some other embodiments, the decision circuit 120 may dynamically determine the weight a according to the primary gray level value $GL_{max}$. The decision circuit 120 may calculate a weighted calculation result GL by using Formula 1 and employ the weighted calculation result GL as the global gray level, wherein the weight α is a real number. Based on a design requirement, in some embodiments, the weight a may be a real number ranging between 0 and 2. It is assumed that a range of the gray level values is from 0 to 255, and when the weighted calculation result GL is greater than 255, the decision circuit 120 may employ "255" as the global gray level.

$$GL=GL_{max}*\alpha \quad \text{Formula 1}$$

In some other embodiments, the analysis result includes the primary gray level value $GL_{max}$, and the weight includes the weight α. The decision circuit 120 may calculate the weighted calculation result GL by using Formula 1 described above. It is assumed that a range of the gray level values is from 0 to 255, and when the weighted calculation result GL is greater than 255, the decision circuit 120 may employ "255" as the weighted calculation result. The decision circuit 120 may obtain the global gray level by using the weighted calculation result GL and a look-up table. Specific contents related to the look-up table may be schemed based on a design requirement. For example, the decision circuit 120 may convert the weighted calculation result GL into the global gray level by using a look-up table shown in Table 2. A range assumed in the example shown in Table 2 is from 0 to 255, however, ranges of gray level values in other embodiments are not limited thereto.

TABLE 2

| An example of look-up table | |
|---|---|
| GL | Global gray level |
| 0 | 0 |
| 32 | 230 |

TABLE 2-continued

| An example of look-up table | |
|---|---|
| GL | Global gray level |
| 64 | 255 |
| 96 | 130 |
| 128 | 100 |
| 160 | 130 |
| 192 | 100 |
| 224 | 100 |
| 225 | 120 |

For example, it is assumed that the weighted calculation result GL is "128". The decision circuit 120 may obtain the global gray level of "100" by using the look-up table. Moreover, in another example, it is assumed that the weighted calculation result GL is "150". The decision circuit 120 may obtain two values of "100" and "130" by using the look-up table shown in Table 2. The decision circuit 120 may perform an interpolation operation on the values of "100" and "130" to obtain the global gray level.

In some other embodiments, the analysis result includes the average gray level value $GL_{avg}$, and the weight includes a weight β. In some embodiments, the weight β may be a static value (or a fixed value) set based on a design requirement. In some other embodiments, the decision circuit 120 may dynamically determine the weight β according to the average gray level value $GL_{avg}$. The decision circuit 120 may calculate the weighted calculation result GL by using Formula 2 and employ the weighted calculation result GL as the global gray level, wherein the weight β is a real number. Based on a design requirement, in some embodiments, the weight β may be a real number ranging between 0 and 2. It is assumed that a range of the gray level values is from 0 to 255, and when the weighted calculation result GL is greater than 255, the decision circuit 120 may employ "255" as the global gray level.

$$GL=GL_{avg}*\beta \quad \text{Formula 2}$$

In some other embodiments, the analysis result includes the average gray level value $GL_{avg}$, and the weight includes the weight β. The decision circuit 120 may calculate the weighted calculation result GL by using Formula 2 described above. It is assumed that a range of the gray level values is from 0 to 255, and when the weighted calculation result GL is greater than 255, the decision circuit 120 may employ "255" as the weighted calculation result GL. The decision circuit 120 may obtain the global gray level by using the weighted calculation result GL and the look-up table. Specific contents related to the look-up table may be schemed based on a design requirement. For example, the decision circuit 120 may convert the weighted calculation result GL into the global gray level by using the look-up table shown in Table 2.

In some other embodiments, the analysis result includes the primary gray level value $GL_{max}$ and the average gray level value $GL_{avg}$, and the weights include the weight α and the weight β. In some embodiments, the weight α and (or) the weight β may be static values (or fixed values) set based on a design requirement. In some other embodiments, the decision circuit 120 may dynamically determine the weight α and (or) the weight β according to the primary gray level value $GL_{max}$ and (or) the average gray level value $GL_{avg}$. The decision circuit 120 may calculate the weighted calculation result GL by using Formula 3 and employ the weighted calculation result GL as the global gray level. It is assumed that a range of the gray level values is from 0 to 255, and when the weighted calculation result GL is greater than 255, the decision circuit 120 may employ "255" as the global gray level.

$$GL=GL_{max}*\alpha+GL_{avg}*\beta \quad \text{Formula 3}$$

In some other embodiments, the analysis result includes the primary gray level value $GL_{max}$ and the average gray level value $GL_{avg}$, and the weights includes the weight α and the weight β. The decision circuit 120 may calculate the weighted calculation result GL by using Formula 3 described above. It is assumed that a range of the gray level values is from 0 to 255, and when the weighted calculation result GL is greater than 255, the decision circuit 120 may employ "255" as the weighted calculation result GL. The decision circuit 120 may obtain the global gray level by using the weighted calculation result GL and the look-up table. Specific contents related to the look-up table may be schemed based on a design requirement. For example, the decision circuit 120 may convert the weighted calculation result GL into the global gray level by using the look-up table shown in Table 2.

In some other embodiments, the decision circuit 120 may dynamically determine at least one weight according to the analysis result. The decision circuit 120 may calculate the weighted calculation result by using the at least one weight weight and the analysis result. The decision circuit 120 may obtain a current frame frequency according to the external information provided by the front stage circuit 11. The decision circuit 120 may obtain the global gray level by using the weighted calculation result, the current frame frequency and a look-up table. Specific contents related to the look-up table may be schemed based on a design requirement.

For example, the analysis result includes the primary gray level value $GL_{max}$ and the average gray level value $GL_{avg}$. The decision circuit 120 may dynamically determine the weight α and (or) the weight β according to the primary gray level value $GL_{max}$ and the average gray level value $GL_{avg}$. The decision circuit 120 may calculate the weighted calculation result GL by using Formula 3 described above. It is assumed that a range of the gray level values is from 0 to 255, and when the weighted calculation result GL is greater than 255, the decision circuit 120 may employ "255" as the weighted calculation result GL. In addition, the decision circuit 120 may obtain a current frame frequency Fcf according to the external information provided by the front stage circuit 11. The decision circuit 120 may obtain the global gray level by using the weighted calculation result GL, the current frame frequency Fcf and the look-up table shown in Table 3.

TABLE 3

Another example of look-up table

| Global gray level | | Fcf 60 Hz | 40 Hz | 30 Hz | 23 Hz | 20 Hz |
|---|---|---|---|---|---|---|
| GL | 0 | 0 | 0 | 0 | 0 | 0 |
| | 32 | 230 | 220 | 200 | 195 | 195 |
| | 64 | 255 | 245 | 235 | 225 | 210 |
| | 96 | 130 | 130 | 180 | 180 | 200 |
| | 128 | 100 | 100 | 220 | 200 | 210 |
| | 160 | 130 | 130 | 210 | 210 | 235 |
| | 192 | 100 | 100 | 220 | 224 | 245 |
| | 224 | 100 | 100 | 245 | 224 | 252 |
| | 225 | 120 | 120 | 255 | 255 | 255 |

For example, it is assumed that the weighted calculation result GL is "128", and the current frame frequency Fcf is "60 Hz". The decision circuit 120 may obtain the global gray level of "100" by using the look-up table. Moreover, in an other example, it is assumed that the weighted calculation result GL is "150", and the current frame frequency Fcf is "50 Hz". The decision circuit 120 may obtain four values of "100", "100", "130" and "130" by using the look-up table shown in Table 3. The decision circuit 120 may perform an interpolation operation on the values of "100", "100", "130" and "130" to obtain the global gray level.

The output circuit (not shown) of the timing controller 100 may transmit the global gray level output by the decision circuit 120 to the driving circuit of the display panel 12. The driving circuit of the display panel 12 may convert the global gray level into a data voltage. The display panel 12 has at least one data line. In the blanking interval, the data voltage corresponding to the global gray level may be applied to one or more data lines corresponding to the sub-pixel circuits (step S230). In some embodiments, the data voltage corresponding to the global gray level may be applied to all the data lines of the display panel 12 in the blanking interval.

Based on a design requirement, the blanking interval may include a vertical blanking interval and (or) a horizontal blanking interval). In the blanking interval, multiple of the sub-pixel circuits (e.g., all of the sub-pixel circuits) of the display panel 12 are turned off. Namely, the voltages of the data lines are incapable of being stored in the sub-pixel circuits in the blanking interval. The data voltage corresponding to the global gray level may be applied to the data lines corresponding to the sub-pixel circuits which are turned off, thereby compensating a leakage current situation of thin film transistors (TFTs) of the sub-pixel circuits. Thus, the timing controller 100 may prevent the screen from flickering during a process in which a refresh rate (or a frame rate) is changed. In addition, because the data voltage (the global gray level) is only applied to the data lines of the display panel 12 in the period in which the sub-pixel circuits are all turned off, the gray level voltages (the pixel voltages) stored in the sub-pixel circuits are not changed by the data voltage (the global gray level).

Figure 3:
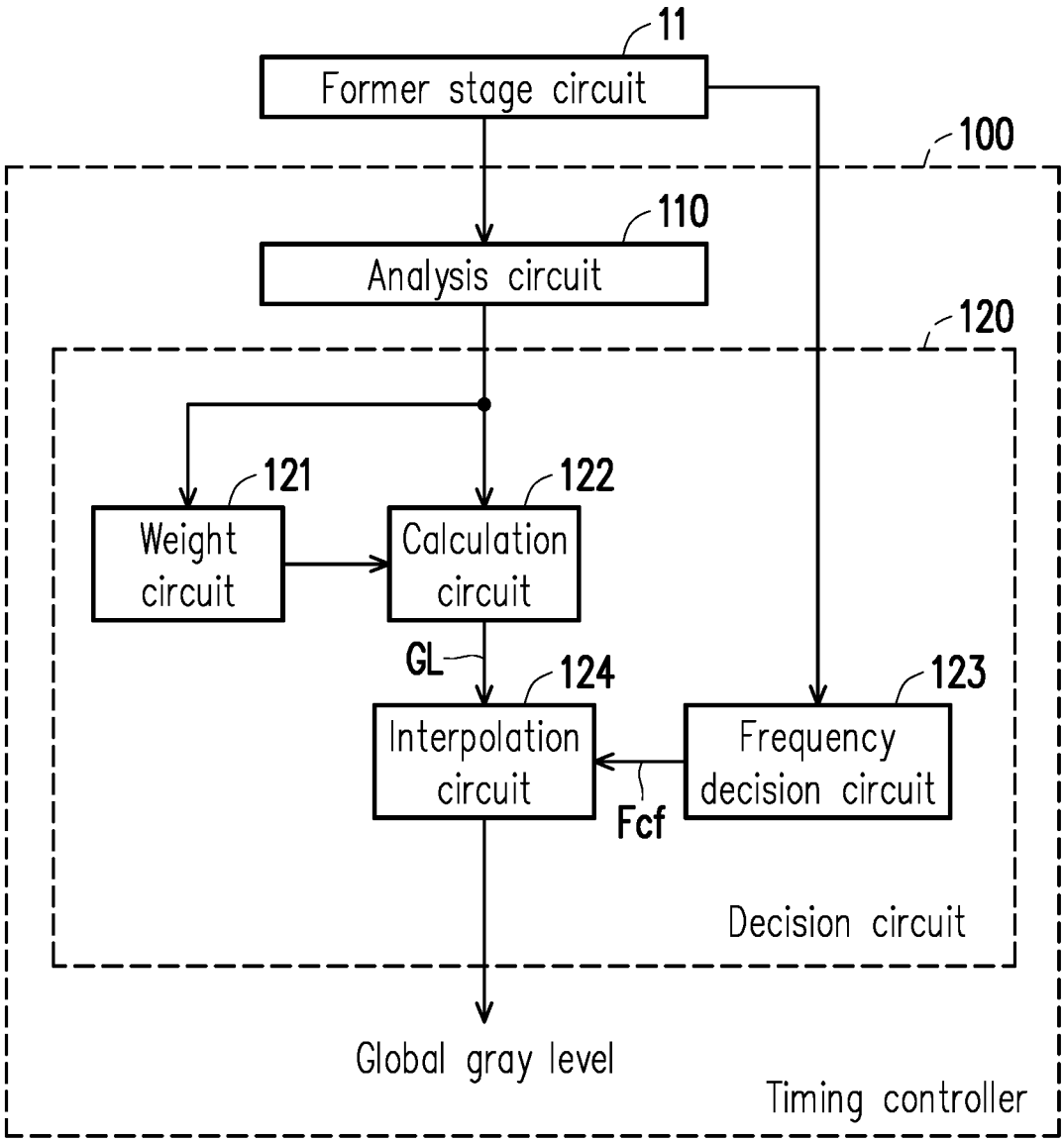
FIG. 3 is a schematic circuit block diagram illustrating the decision circuit depicted in FIG. 1 according to an embodiment of the invention.

FIG. 3 is a schematic circuit block diagram illustrating the decision circuit 120 depicted in FIG. 1 according to an embodiment of the invention. The decision circuit 120 illustrated in FIG. 3 includes a weight circuit 121, a calculation circuit 122, a frequency decision circuit 123 and an interpolation circuit 124. The weight circuit 121 is coupled to the analysis circuit 110 to receive the analysis result (e.g., the primary gray level value $GL_{max}$ and/or the average gray level value $GL_{avg}$). The decision circuit 121 may dynamically determine at least one weight (e.g., the weight α and/or the weight β) according to the analysis result. A relation between the analysis result and the weight may be schemed based on a design requirement. In some embodiments, the weight α and (or) the weight β may be static values (or fixed values) set based on a design requirement. In some other embodiments, the decision circuit 120 may dynamically determine the weight α and (or) the weight β according to the primary gray level value $GL_{max}$ and the average gray level value $GL_{avg}$.

The calculation circuit 122 is coupled to the weight circuit 121 to receive weight (e.g., the weight α and/or the weight β). The calculation circuit 122 is coupled to the analysis circuit 110 to receive the analysis result (e.g., the primary gray level value $GL_{max}$ and/or the average gray level value $GL_{avg}$). The calculation circuit 122 may calculate the weighted calculation result GL by using the weight and the analysis result. For example, the decision circuit 122 may calculate the weighted calculation result GL by using Formula 1, Formula 2 or Formula 3 described above.

The frequency decision circuit 123 may obtain the current frame frequency Fcf according to the external information provided by the front stage circuit 11. The interpolation circuit 124 is coupled to the frequency decision circuit 123 to receive the current frame frequency Fcf. The interpolation circuit 124 is coupled to the calculation circuit 122 to receive the weighted calculation result GL. The interpolation circuit 124 may obtain the global gray level by using the weighted calculation result GL, the current frame frequency Fcf and the look-up table. Specific contents related to the look-up table may be schemed based on a design requirement. For example, the decision circuit 124 may obtain the global gray level by using the weighted calculation result GL, the current frame frequency Fcf and the look-up table shown in Table 3.

Based on different design requirements, the blocks of the analysis circuit 110, the decision circuit 120, the weight circuit 121, the calculation circuit 122, the frequency decision circuit 123 and (or) the interpolation circuit 124 may be implemented in a form of hardware, firmware, software (i.e., programs) or in a combination of many of the aforementioned three forms.

In terms of the hardware form, the blocks of the analysis circuit 110, the decision circuit 120, the weight circuit 121, the calculation circuit 122, the frequency decision circuit 123 and (or) the interpolation circuit 124 may be implemented in a logic circuit on a integrated circuit. Related functions of the analysis circuit 110, the decision circuit 120, the weight circuit 121, the calculation circuit 122, the frequency decision circuit 123 and (or) the interpolation circuit 124 may be implemented in the form of hardware by utilizing hardware description languages (e.g., Verilog HDL or VHDL) or other suitable programming languages. For example, the related functions of the analysis circuit 110, the decision circuit 120, the weight circuit 121, the calculation circuit 122, the frequency decision circuit 123 and (or) the interpolation circuit 124 may be implemented in one or more controllers, micro-controllers, microprocessors, application-specific integrated circuits (ASICs), digital signal processors (DSPs), field programmable gate arrays (FPGAs) and/or various logic blocks, modules and circuits in other processing units.

In terms of the software form and/or the firmware form, the related functions of the analysis circuit 110, the decision circuit 120, the weight circuit 121, the calculation circuit 122, the frequency decision circuit 123 and (or) the interpolation circuit 124 may be implemented as programming codes. For example, the analysis circuit 110, the decision circuit 120, the weight circuit 121, the calculation circuit 122, the frequency decision circuit 123 and (or) the interpolation circuit 124 may be implemented by using general programming languages (e.g., C or C++) or other suitable programming languages. The programming codes may be recorded/stored in recording media, and the aforementioned recording media include, for example, a read only memory (ROM), a storage device and/or a random access memory (RAM). Additionally, the programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g., a communication network or radio waves). The communication network is, for example, the Internet, wired communication, wireless communication or other communication media.

Based on the above, in some embodiments, an operation frequency of the display panel 12 (e.g., an LCD panel) is dependent on the vertical blanking. A length of the vertical blanking interval at a low operation frequency is greater than a length of the vertical blanking interval at a high operation frequency. When the operation frequency of the display panel 12 is switched to the low frequency, the luminance is reduced due to the occurrence of a leakage current in the pixel circuits. When the operation frequency of the display panel 12 is switched to the low frequency, e.g., the current frame frequency Fcf is switched from 120 Hz to 60 Hz, the timing controller 100 may provide the global gray level to the driving circuit of the display panel 12, and the driving circuit may apply the data voltage corresponding to the global gray level to the data lines of the display panel 12 in the vertical blanking interval, thereby compensating a luminance difference. Thus, the timing controller can prevent the screen from flickering as much as possible during the process in which the refresh rate (or the frame rate) is changed.

In addition, because the data voltage (the global gray level) is applied to the data lines corresponding to the sub-pixel circuits in the period in which the sub-pixel circuits of the display panel 12 are all turned off, the gray level voltages (the pixel voltages) stored in the sub-pixel circuits are not changed by the data voltage (the global gray level). In this way, the timing controller can avoid color shift.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A timing controller, configured to control a signal timing of a display panel, comprising:

an analysis circuit, configured to analyze a content of an image frame to obtain an analysis result; and a decision circuit, coupled to the analysis circuit to receive the analysis result and configured to determine a global gray level according to the analysis result, wherein in a blanking interval in which a plurality of sub-pixel circuits of the display panel are turned off, a data voltage corresponding to the global gray level is applied to at least one data line of the display panel corresponding to the sub-pixel circuits.

2. The timing controller according to claim 1, wherein the analysis circuit is configured to analyze a gray level distribution of the image frame to obtain the analysis result.

3. The timing controller according to claim 2, wherein the image frame comprises a plurality of pixels, each of the pixels comprises a plurality of sub-pixels, the analysis circuit selects a gray level value from gray level values of the sub-pixels of a current pixel among the pixels as a representative gray level value of the current pixel, and the analysis circuit analyzes a gray level distribution of the representative gray level values of the pixels to obtain the analysis result.

4. The timing controller according to claim 3, wherein the representative gray level value of the current pixel is a maximum gray level value, a median gray level value, a minimum gray level value or an average gray level value from the gray level values of the sub-pixels of the current pixel.

5. The timing controller according to claim 1, wherein the analysis result comprises a primary gray level value, the primary gray level value is a gray level value with a most screen ratio of the image frame, and the screen ratio is a ratio of the number of pixels having a same gray level value to a total number of the pixels of the image frame.

6. The timing controller according to claim 1, wherein the analysis circuit quantizes a plurality of gray level values of a plurality of pixels of the image frame to obtain a plurality of quantized values of the pixels, the analysis result comprises a primary gray level value, the primary gray level value is a quantized value with a most screen ratio among the quantized values, and the screen ratio is a ratio of the number of pixels having a same quantized value to a total number of the pixels of the image frame.

7. The timing controller according to claim 1, wherein the analysis result comprises an average gray level value, and the average gray level value is an average value of a plurality of gray level values of a plurality of pixels of the image frame.

8. The timing controller according to claim 1, wherein the analysis circuit quantizes a plurality of gray level values of a plurality of pixels of the image frame to obtain a plurality of quantized values of the pixels, the analysis result comprises an average gray level value, and the average gray level value is an average value of the quantized values.

9. The timing controller according to claim 1, wherein the decision circuit calculates the global gray level by using at least one weight and the analysis result.

10. The timing controller according to claim 9, wherein the decision circuit dynamically determines the at least one weight according to the analysis result.

11. The timing controller according to claim 1, wherein the decision circuit calculates a weighted calculation result by using at least one weight and the analysis result, and the decision circuit obtains the global gray level by using the weighted calculation result and a look-up table.

12. The timing controller according to claim 1, wherein the decision circuit dynamically determines at least one weight according to the analysis result, the decision circuit calculates a weighted calculation result by using the at least one weight and the analysis result, the decision circuit obtains a current frame frequency according to external information, and the decision circuit obtains the global gray level by using the weighted calculation result, the current frame frequency and a look-up table.

13. The timing controller according to claim 1, wherein the decision circuit comprises:

a weight circuit, coupled to the analysis circuit to receive the analysis result and configured to dynamically determine at least one weight according to the analysis result;

a calculation circuit, coupled to the weight circuit to receive the at least one weight, coupled to the analysis circuit to receive the analysis result and configured to calculate a weighted calculation result by using the at least one weight and the analysis result;

a frequency decision circuit, configured to obtain a current frame frequency according to external information; and an interpolation circuit, coupled to the calculation circuit to receive the weighted calculation result, coupled to the frequency decision circuit to receive the current frame frequency and configured to obtain the global gray level by using the weighted calculation result, the current frame frequency and a look-up table.

14. An operation method of a timing controller configured to control a signal timing of a display panel, the operation method comprising:

analyzing a content of an image frame by an analysis circuit of the timing controller to obtain an analysis result;

determining a global gray level according to the analysis result by a decision circuit of the timing controller; and in a blanking interval in which a plurality of sub-pixel circuits of the display panel are turned off, applying a data voltage corresponding to the global gray level to at least one data line of the display panel corresponding to the sub-pixel circuits.

15. The operation method according to claim 14, further comprising:

analyzing a gray level distribution of the image frame by the analysis circuit to obtain the analysis result.

16. The operation method according to claim 15, wherein the image frame comprises a plurality of pixels, each of the pixels comprises a plurality of sub-pixels, and the operation method further comprises:

selecting a gray level value from gray level values of the sub-pixels of a current pixel among the pixels as a representative gray level value of the current pixel by the analysis circuit; and analyzing a gray level distribution of the representative gray level values of the pixels by the analysis circuit to obtain the analysis result.

17. The operation method according to claim 16, wherein the representative gray level value of the current pixel is a maximum gray level value, a median gray level value, a minimum gray level value or an average gray level value from the gray level values of the sub-pixels of the current pixel.

18. The operation method according to claim 14, wherein the analysis result comprises a primary gray level value, the primary gray level value is a gray level value with a most screen ratio of the image frame, and the screen ratio is a ratio of the number of pixels having a same gray level value to a total number of the pixels of the image frame.

19. The operation method according to claim 14, further comprising:

quantizing a plurality of gray level values of a plurality of pixels of the image frame by the analysis circuit to obtain a plurality of quantized values of the pixels, wherein the analysis result comprises a primary gray level value, the primary gray level value is a quantized value with a most screen ratio among the quantized values, and the screen ratio is a ratio of the number of pixels having a same quantized value to a total number of the pixels of the image frame.

20. The operation method according to claim 14, wherein the analysis result comprises an average gray level value, and the average gray level value is an average value of a plurality of gray level values of a plurality of pixels of the image frame.

21. The operation method according to claim 14, further comprising:

quantizing a plurality of gray level values of a plurality of pixels of the image frame by the analysis circuit to obtain a plurality of quantized values of the pixels, wherein the analysis result comprises an average gray level value, and the average gray level value is an average value of the quantized values.

22. The operation method according to claim 14, further comprising:

calculating the global gray level by the decision circuit using at least one weight and the analysis result.

23. The operation method according to claim 22, further comprising:

dynamically determining the at least one weight according to the analysis result by the decision circuit.

24. The operation method according to claim 14, further comprising:

calculating a weighted calculation result by the decision circuit using at least one weight and the analysis result; and obtaining the global gray level by the decision circuit using the weighted calculation result and a look-up table.

25. The operation method according to claim 14, further comprising:

dynamically determining at least one weight according to the analysis result by the decision circuit;

calculating a weighted calculation result by the decision circuit using the at least one weight and the analysis result;

obtaining a current frame frequency according to external information by the decision circuit; and obtaining the global gray level by the decision circuit using the weighted calculation result, the current frame frequency and a look-up table.

* * * * *